US012428754B2

(12) United States Patent
Stevens

(10) Patent No.: US 12,428,754 B2
(45) Date of Patent: Sep. 30, 2025

(54) WRAPPED CORD FOR REINFORCING A RUBBER PRODUCT

(71) Applicant: NGF EUROPE Limited, St Helens (GB)

(72) Inventor: Christopher Andrew Stevens, St Helens (GB)

(73) Assignee: NGF EUROPE LIMITED, St Helens (GB)

( * ) Notice: Subject to any disclaimer, the term of this patent is extended or adjusted under 35 U.S.C. 154(b) by 107 days.

(21) Appl. No.: 17/791,102

(22) PCT Filed: Jan. 5, 2021

(86) PCT No.: PCT/EP2021/050064

§ 371 (c)(1),
(2) Date: Jul. 6, 2022

(87) PCT Pub. No.: WO2021/140092

PCT Pub. Date: Jul. 15, 2021

(65) Prior Publication Data

US 2023/0043287 A1 Feb. 9, 2023

(30) Foreign Application Priority Data

Jan. 7, 2020 (GB) ..... 2000164

(51) Int. Cl.
*D02G 3/44* (2006.01)
*D02G 3/38* (2006.01)

(52) U.S. Cl.
CPC ..... *D02G 3/447* (2013.01); *D02G 3/38* (2013.01)

(58) Field of Classification Search
CPC ..... D02G 3/447; D02G 3/38; D02G 3/48
See application file for complete search history.

(56) References Cited

U.S. PATENT DOCUMENTS 3,243,338 A * 3/1966 Jackson ..... D02G 3/48 428/401
3,780,515 A * 12/1973 Waters ..... D02G 3/24 57/283
3,983,761 A * 10/1976 Stewart ..... A24C 5/1857 474/260
4,173,678 A * 11/1979 Hennes ..... D02G 3/346 428/397

(Continued)

FOREIGN PATENT DOCUMENTS

DE 2428484 A1 12/1975
EP 1225260 A1 7/2002

(Continued)

OTHER PUBLICATIONS

Stevens, C. A. et al., "Reinforcement of Rubber by Reactive Impregnation Glass Cords," No. 85, 170th Technical Meeting of the Rubber Division, American Chemical Society, 2006, 31 pages.

(Continued)

*Primary Examiner* — Bao-Thieu L Nguyen
(74) *Attorney, Agent, or Firm* — HSML P.C.

(57) ABSTRACT

A cord for reinforcing a rubber product, comprising a core (9) and at least one thread (8) wrapped around the core, wherein the core comprises at least one strand of filaments, and wherein the linear density of the core is greater than the linear density of the thread.

18 Claims, 4 Drawing Sheets

(56) References Cited

U.S. PATENT DOCUMENTS

| | | | | |
|---|---|---|---|---|
| 4,272,950 | A | 6/1981 | Bompard | |
| 4,499,716 | A * | 2/1985 | Antal | D02G 3/447 57/902 |
| 4,548,866 | A * | 10/1985 | Cordova | D02G 3/447 428/401 |
| 5,368,928 | A | 11/1994 | Okamura et al. | |
| 6,796,115 | B1 * | 9/2004 | Patrick | D02G 3/22 57/236 |
| 2004/0148921 | A1 * | 8/2004 | Guevel | D02G 3/442 57/229 |
| 2009/0301629 | A1 * | 12/2009 | Zuigyo | B60C 9/0042 152/560 |
| 2011/0017378 | A1 * | 1/2011 | Shimada | D03D 15/283 428/297.4 |
| 2011/0259501 | A1 * | 10/2011 | Assaad | B60C 9/005 152/527 |
| 2013/0205979 | A1 * | 8/2013 | Nelis | D07B 1/16 57/244 |
| 2013/0239539 | A1 * | 9/2013 | Li | D02G 3/36 57/3 |
| 2014/0000750 | A1 * | 1/2014 | Carrara | D02G 3/365 139/420 R |
| 2014/0150948 | A1 * | 6/2014 | Kavaturu | D02G 3/48 57/237 |
| 2014/0345772 | A1 * | 11/2014 | Assaad | B60C 9/18 152/527 |
| 2017/0175301 | A1 * | 6/2017 | Bader | D02G 3/447 |
| 2019/0134271 | A1 * | 5/2019 | Seo | A61L 27/3834 |
| 2020/0407889 | A1 * | 12/2020 | Gupta | B65H 54/026 |

FOREIGN PATENT DOCUMENTS

| | | | |
|---|---|---|---|
| EP | 1225261 | A1 | 7/2002 |
| WO | 2019013091 | A1 | 1/2019 |

OTHER PUBLICATIONS

International Search Report and Written Opinion issued for International Patent Application No. PCTEP2021050064, Date of mailing: Apr. 16, 2021, 13 pages.

* cited by examiner

WRAPPED CORD FOR REINFORCING A RUBBER PRODUCT

FIELD OF THE INVENTION

The invention relates to a cord for reinforcing a rubber product, a method for producing the reinforcing cord, and a rubber product including the reinforcing cord. The cord comprises a central core wrapped by at least one thread, wherein the linear density of the core is greater than the linear density of the thread.

BACKGROUND OF THE INVENTION

Typically, reinforcing cords are used to provide linear stiffness, strength and durability to rubber products such as a rubber belt used for driving a camshaft of an internal combustion engine, used for driving an auxiliary unit such as an injection pump or power transmission in an industrial machine, or used for high pressure rubber hoses used in aeroplanes. Generally, a rubber belt has a rubber portion with one or more reinforcing cords embedded in the rubber portion. The reinforcing cord adds strength, stiffness and length stability to the rubber belt.

Good performance of rubber products can be achieved using rubber impregnated glass cords where the glass cords comprise, for example, E glass fibres having a density of 2.5 g/ml, a tensile modulus of about 70-80 GPa, and an elongation to break of 4%. The reinforcement of rubber can be considerably enhanced using cords comprising carbon fibres having a density of 1.8 g/ml, a tensile modulus of about 250 GPa and an elongation to break of about 2%. However, although an increase in stiffness (as indicated by tensile modulus) and a decrease in weight can be achieved using carbon fibres, the associated advantages have to be balanced against the low elongation to break (2%). In use, a rubber belt will pass around pulleys. The pulleys will apply a bend to the belt and to a reinforcing cord within the belt. This will result in a tensile bending strain being imposed on the outside of the cord and a compressive bending strain being imposed on the inside of the cord. This compressive strain can cause some of the fibres of the cord to deform and move from their position within the cord. If the deformation causes a sharp bend in the fibre this is called a crimp. In three-point bending, carbon cord has been observed to bend smoothly until a critical point is attained and, at this point, the cord can then crimp, i.e. fold at a sharp angle. This is illustrated in FIG. 1. Once crimped, a fibre will fail relatively quickly after further fatigue. Typically, a cord made with 12K (12000 filaments) carbon fibre will have a diameter just over 1 mm. If such a cord is bent with a radius of curvature of 50 mm, then, typically, the bending strain of the outermost portion of the cord will be at 1.0%. Thus, the outermost portion of the cord will be 50% of the way towards breaking, as when the bending strain increases to 2% the outermost portion of the cord will break. This is disadvantageous for applications of carbon fibres which involve bending, such as for reinforcement of rubber belts.

There is, in particular, a need to extend the fatigue life of carbon by increasing its resistance to crimping and bending fatigue (caused by repeated bending stresses).

Further, crimping of carbon fibres in a rubber belt under bending stress is also a problem at low temperatures, due to the encapsulated rubber having a drastic increase in stiffness as the glass transition is approached. This increases the local bending on the cord. There is a need to provide new reinforcing cords suitable for low temperature use.

The size of the reinforcing cords used in rubber products influences the number of cords that can be distributed in the rubber product and the size of the rubber product. For example, if smaller cords can provide the required reinforcing stiffness then the reinforced rubber products can be made smaller. The use of smaller rubber belts in the engine vehicles will increase fuel efficiency (narrower rubber belts, narrower pulleys and, as a result, the vehicle will be less heavy). There is also an efficiency advantage in the costs of producing the rubber products (less rubber required). Further, a cord with a low diameter will suffer less bending strain than a cord with a larger diameter under the same bending stress.

There is a need to provide new cords for reinforcing rubber products, such as rubber timing belts. There is a need to provide new cords for reinforcing rubber products that have a good resistance to bending fatigue. There is a need to provide a cord for reinforcing rubber products that retains the linear stiffness and low density associated with carbon fibres, but has an improved bending performance (for example, compared to that of known carbon fibre cords). The improved bending performance can be, for example, a reduction or the removal of the tendency of the cord to crimp.

The present invention sets out to meet some or all of these needs and to solve some or all of the above-identified problems.

SUMMARY OF THE INVENTION

In a first aspect, the invention provides a cord for reinforcing a rubber product, comprising a core and at least one thread wrapped around the core, wherein the core comprises at least one strand of filaments, and wherein the linear density of the core is greater than the linear density of the thread.

It has been found that the cords of the invention have increased resistance to crimping. It is believed that the thread wrapped around the core holds the filaments in place, restricting their ability to move, deform and crimp. In particular, when the core contains carbon filaments, the reinforced cord of the invention comprising carbon filaments has excellent stiffness, is light and has excellent resistance to crimping under bending stresses.

In another aspect, the invention provides a method of preparing a cord for reinforcing a rubber product comprising wrapping a thread around a core, wherein the core comprises at least one strand of filaments. The method can be used to prepare the reinforcing cords of the first aspect of the invention.

In another aspect, the invention provides a method of increasing the resilience of a core to bending, wherein said core comprises at least one strand of filaments, wherein said method comprises wrapping a thread around the core. The core and the thread can be as defined for the first aspect of the invention In another aspect, the invention provides a rubber product comprising a rubber composition and at least one reinforcing cord according to the first aspect of the invention embedded in the rubber composition.

DETAILED DESCRIPTION OF THE INVENTION

Figure 1:
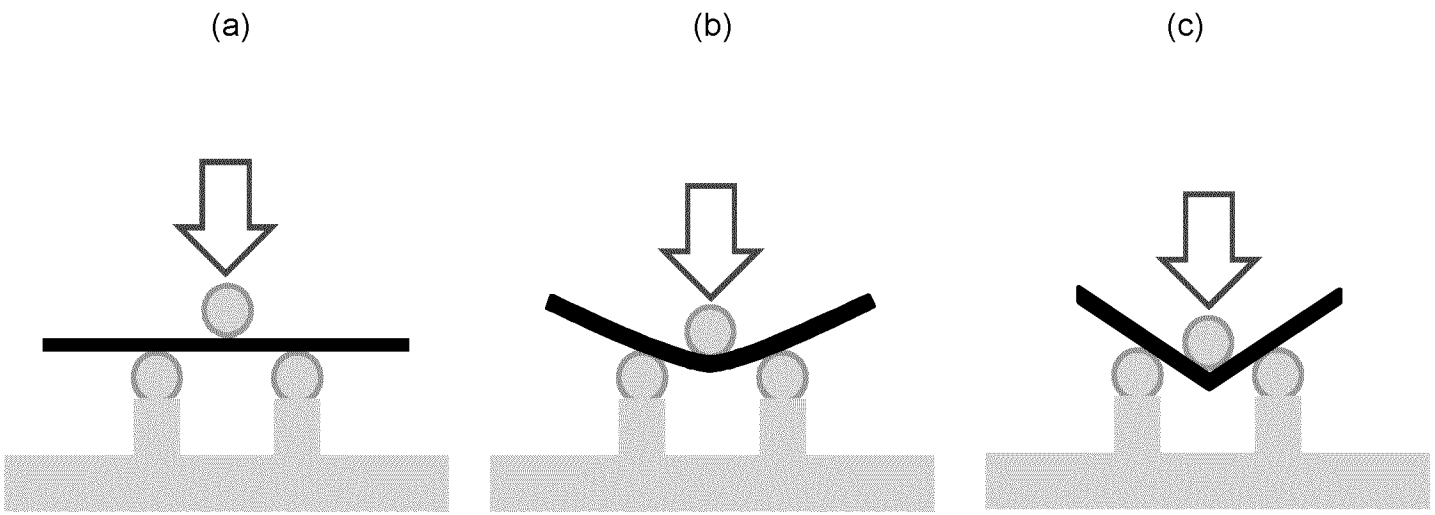
FIG. 1 illustrates typical behaviour of a carbon cord in a three-point test, i.e. the cord behaviour (a) before bending, (b) while smoothly bending, and then (c) crimping at a sharp angle.

In a first aspect, the invention provides a cord for reinforcing a rubber product, comprising a core and at least one thread wrapped around the core, wherein the core comprises at least one strand of filaments, and wherein the linear density of the core is greater than the linear density of the thread.

In the cord of the invention, the core has greater linear density than the thread wrapped around it. Linear density is mass per unit length (with units of kg/m or g/m) and can be determined, for example, by measuring the length of a material and weighing it. It has been found that the cord of the invention has good resistance to crimping due to bending and thus has applications in extending the bending fatigue life of rubber products. Advantageously, the design of the cord allows this to be achieved using relatively lightweight and non-bulky materials. The cord is particularly useful for reinforcing rubber products such a rubber tyres, rubber timing belts and other power transmission belts. The cord of the invention can act as a relatively small and lightweight reinforcement system for rubber products. This can result in the production of, for example, narrower rubber timing belts which will have associated efficiencies in production. Preferably, the cord is metal-free, i.e. the core does not contain metal and the thread does not contain metal.

Typically, the core has a linear density of at least 200 g/km and, preferably, has a linear density of from 200 to 8000 g/km, of from 400 to 1200 g/km or of from 400 to 800 g/km.

Typically, the thread has a linear density of not more than 50 g/km and, preferably not more than 10 g/km or, preferably of from 3 to 8 g/km.

The core can have a linear density of at least 200 g/km and, preferably, has a linear density of from 200 to 8000 g/km, of from 400 to 1200 g/km or of from 400 to 800 g/km, and the thread can have a linear density of not more than 50 g/km. The core can have a linear density of at least 200 g/km and, preferably, has a linear density of from 200 to 8000 g/km, of from 400 to 1200 g/km or of from 400 to 800 g/km, and the thread can have a linear density of not more than 20 g/km. The core can have a linear density of at least 200 g/km and the thread can have a linear density of not more than 10 g/km or a linear density of from 3 to 8 g/km. The core can have a linear density of from 200 g/km to 8000 g/km and the thread can have a linear density of not more than 10 g/km or a linear density of from 3 to 8 g/km. The core can have a linear density of from 400 g/km to 1200 g/km and the thread can have a linear density of not more than 10 g/km or a linear density of from 3 to 8 g/km. The core can have a linear density of from 400 g/km to 800 g/km and the thread can have a linear density not more than 10 g/km or a linear density of from 3 to 8 g/km.

The core can have zero twist or it can have a twist of greater than zero. For example, the core can have a twist of from greater than zero to 240 tpm. This is the twist of the core and this is also referred to herein as the core twist. The core comprises at least one strand of filaments, also referred to herein as a strand. The core can comprise a single strand or it can comprise two or more strands, e.g. two, three or four strands. A strand can itself be twisted and the resultant twist is referred to herein as a primary twist. When two or more strands are twisted together, the resultant twist is referred to herein as a secondary twist. The primary and secondary twists can be in the same or opposite twist directions. When the core comprises a single strand having a primary twist of greater than zero, then the primary twist is what is referred to herein as the twist of the core. When the core comprises two or more strands twisted together to give a secondary twist of greater than zero, then the secondary twist is what is referred to herein as the twist of the core.

Typically, the cord of the invention comprises a core with a twist of greater than zero, and the thread is wrapped around the core at a number of turns per metre that is at least 50% greater than the twist of the core (in turns per metre). In this embodiment, the thread can be wrapped around the core at a number of turns per metre that is from 1.5 to 150 times the twist of the core. The core can have a twist of from greater than 0 to 240 tpm, from greater than 0 to 200 tpm, from 40 to 120 tpm and said thread can be wrapped around the core at a number of turns per metre that is from 1.5 to 150 times the twist of the core. The core can have a twist of from greater than 0 to 240 tpm, from greater than 0 to 200 tpm, from 40 to 120 tpm and said thread can be wrapped around the core at a number of turns per metre of from 500 to 8000. The core can have a twist of from greater than 0 to 240 tpm, from greater than 0 to 200 tpm, from 40 to 120 tpm and said thread can be wrapped around the core at a number of turns per metre of from 1000 to 5000. The wrapping thread can be twisted around itself, or can be untwisted.

The cord of the invention comprises a core and the core comprises at least one strand of filaments. The strand is, in effect, a bundle of filaments. Thus a strand contains multiple filaments. As used herein, the term "filament" is interchangeable with the term "fibre". The filaments can be of any suitable material, for example, carbon, glass, basalt or aramid and/or mixtures thereof. The filaments can be of a single material, for example, the filaments can be carbon, glass, basalt or aramid filaments. Alternatively, the filaments can be a composite of two or more materials, for example, two or more of carbon, glass, basalt and aramid. In one embodiment, the filaments are not filaments of aramid and, for example, the filaments can be of carbon, glass, or basalt and/or mixtures thereof. Also, for example, the filaments can be such that they do not contain aramid, i.e. they can be a composite of two or more materials where the materials do not include aramid. They can be a composite of two or more of carbon, glass and basalt. The filaments can have a diameter of 5 to 20 μm. The filaments can be carbon filaments with, for example, each filament having a diameter of from 5 to 20 μm, 4 to 12 μm, 5 to 8 μm or 5 to 7 μm. The bundle can comprise from 1000 to 24000, or from 6000 to 12000, filaments. For example, the bundle of filaments can be a bundle of carbon filaments having a diameter of 5 to 20 microns and containing from 1000 to 24000 or from 6000 to 12000 filaments.

The strand of filaments can be embedded in a polymer, for example a rubber latex. This can be achieved by impregnating the strand of filaments with an impregnating liquid. The impregnating liquid is typically a polymer, for example a rubber latex or blend of rubber latexes, dispersed in water. Suitable aqueous rubber dispersions (latexes) include: polybutadiene (BR), styrene butadiene (SBR), acrylonitrile-butadiene (NBR), hydrogenated acrylonitrile-butadiene (HNBR), chloroprene (CR), chlorosulphonated polyethylene (CSM), acrylic (ACM) and vinyl pyridine/SBR/BR (VP) amongst others.

Thermoplastic polymers dispersed in water can also be used. The impregnating liquid is applied so that each of the filaments is coated with it. The impregnating liquid can also contain crosslinking agents that act to crosslink the polymer. These can either react immediately or have a delayed reaction, for example, so that crosslinking within the core occurs during vulcanisation of the rubber belt. Thus, the strand can comprise a bundle of filaments impregnated with a polymer. In one embodiment, the core comprises at least one strand impregnated with a polymer/aqueous rubber dispersion. The core can comprise a single strand impregnated with a polymer/aqueous rubber dispersion. The core can comprise two or more strands impregnated with a polymer. Preferably, each strand in the core is impregnated with a polymer/aqueous rubber dispersion. These are also referred to herein as impregnated cores. The impregnation process is well understood in the industry, and is described, for example in "Reinforcement of Rubber by Reactive Impregnation Glass Cords", by C A Stevens, P J Martin, M Akiyama, Paper no. 85, Presented at the Fall 170th Technical Meeting of the Rubber Division, American Chemical Society, Cincinnati, Ohio, Oct. 10-12, 2006, ISSN: 1547-1977. Another example of impregnating strands with a rubber composition is discussed in U.S. Pat. No. 5,368,928A, Okamura et al.

The strand can have zero twist or a twist around itself of greater than zero and, for example, up to about 240 tpm. To obtain an impregnated strand with a (primary) twist of greater than zero, preferably the strand of filaments is impregnated with an impregnating liquid and then, the strand is twisted. That is the strand is twisted after the step of impregnating the strand with the impregnating liquid.

When the core comprises two or more strands, the strands can be twisted together (secondary twist). In this embodiment, preferably each of the strands is impregnated with an impregnating liquid and, optionally, twisted (primary twisting), and then the strands are twisted together (secondary twisting). The primary and secondary twists can be in the same or opposite twist directions.

Typically, when the core comprises two or more strands, all of the strands are twisted together (secondary twist) at the same time to make the core and each of the strands has the same primary twist.

The cord comprises at least one thread wrapped around the core. The thread can be of any suitable material, for example, nylon, polyester, acrylic, elastic polyurethane (such as Lycra, Elastane and Spandex), polyphenylenesulphide (PPS), polyetheretherketone (PEEK), polyetherketoneketone (PEKK) or aramid. The thread can have a diameter of from 0.005 to 0.50 mm, preferably 0.02 to 0.20 mm. The thread has a linear density of not more than 50 g/km, preferably not more than 10 g/km, preferably from 3 to 8 g/km. The thread can have a linear density of not more than 30 g/km.

Figure 4:
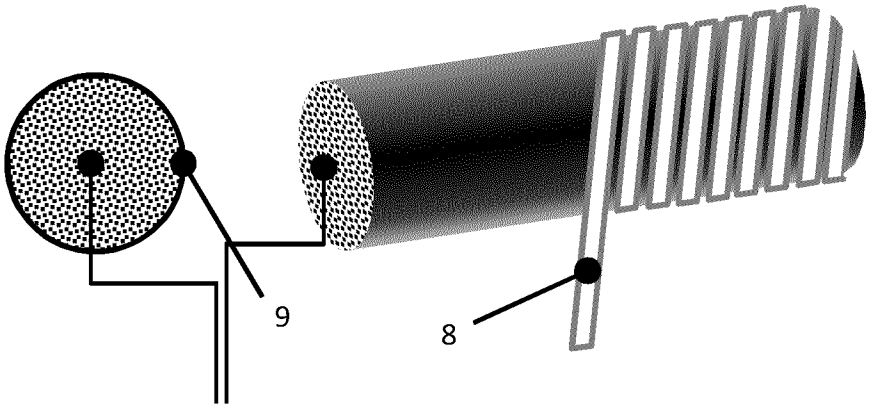
FIG. 4 is an illustration of a wrapped cord according to the invention, where 8 is the thin wrap thread and 9 is the large central core.

The cord can comprise one thread wrapped around the core. FIG. 4 is an illustration of such a cord. Alternatively, the cord can comprise two or more threads wrapped around the core. The cord can comprise two, three or four threads wrapped around the core.

The thread is wrapped around the core at from 500 to 8000 tpm, preferably from 1000 to 5000 tpm. The thread can be wrapped around the core at a number of turns per metre that is at least 50% times the twist of the core or from 1.5 to 150 times the twist of the core.

The thread can be wrapped around the core so that it forms no more than one layer on the core. The thread can be wrapped around the core so that it forms more than one layer on the core, for example two or more layers. Also, for example, it can form a partial second layer or can be a double wrapping, forming two layers. Preferably, the thread is wrapped so that it forms no more than a single layer on the cord. A single thread can be wrapped around the core. More than one thread can be wrapped around the core. When more than one thread is present these can be twisted around the core in the same, or opposite directions. For example two threads can be wound in opposite directions to form a crossing pattern around the core. If more than two threads are used a combination of twist directions can be used.

The thread that is wrapped around the core is relatively lightweight and, furthermore is a lot less bulky than the core. Typically, the cross section of each of the core and the thread is approximately a circle. Typically, the core has a diameter of from 0.5 to 2.5 mm and the thread has a diameter of from 0.005 to 0.50 mm, preferably 0.02 to 0.20 mm. In one embodiment, the diameter of the core plus the diameter of two threads does not exceed 3.0 mm. For example, when a 2.0 mm diameter core has a single layer of wrapping of the thread, the largest dimension of the cord is 3.0 mm.

The thread can have a twist or it can have zero twist. The thread can be a monofilament. The thread can be a bundle of filaments.

Typically, the cross-sectional area of the core is at least 40% of the cross-sectional area of the cord and preferably greater than 80%. Typically, the cross-sectional area of the thread is from 0.04 to 25% of the cross-sectional area of the core. Preferably, the cross-sectional area of the thread is from 0.1 to 20% of the cross-sectional area of the core.

Typically, the core will have a modulus that is greater than the modulus of the thread. For example, the core can have a modulus that is two times or five times greater than the modulus of the thread. When the cord comprises one or two threads wrapped around it, typically, the core will have a modulus that is greater than each of the threads wrapped around it. Thus the cord can comprise one or more relatively flexible threads wrapped around a stiffer core. Modulus is also referred to as tensile modulus herein. The tensile modulus is a property of the material being tested, such that it is independent of sample geometry. The tensile modulus is defined as the slope of the stress versus strain relationship. This can be measured by any known method. For example, ISO-527-1 and 527-2 can be used to measure the modulus of plastics and the ISO 1156 CF test can be used to measure the modulus of higher modulus materials such as carbon, glass and aramid. Alternatively, the modulus can be measured using a force-displacement tensile tester using the following procedure. In order to test bundles of filaments, yarn-cord specific grips or bollard grips are required. The features of these grips are that the tension at the gripping point is lowered, such that failure within the grips is unlikely. A gauge length (free length under tension) of 750 mm is to be used. The grips are to be moved apart at a constant speed of 10 mm/min (only just above 1% strain per minute). The strain is calculated as the change in displacement divided by the gauge length. The instrument measures the force as the displacement increases. The stress is the measured force divided by the area of the sample. For griege bundles of filaments, the area being tested is the linear density (mass per length) divided by the density (mass per volume). The relationship between stress and strain is not always linear. Hence, a chord modulus is used to obtain the slope of change in stress divided by change in strain between strain levels of 0.1% and 0.6%. Using this test, example tensile modulus values for fibre bundles were obtained: high strength U (S2) glass: 103 GPa, Technora co-polymer aramid 85 GPa and Toray T700S carbon fibre 228 GPa.

Typical values of the modulus of materials suitable for use in the cord of the present invention are given in the table below (obtained from https://omnexus.specialchem.com):

| Material | Core | Thread |
|---|---|---|
| Carbon | 230 GPa | |
| High strength glass | 85 GPa | |
| E glass | 70 GPa | |
| Basalt | 90 GPa | |
| Nylon | | 10 GPa |
| Polyester | | 3 GPa |
| Acrylic | | 3 GPa |
| Elastic polyurethane | | <1 GPa |
| PPS | | 4 GPa |
| PEEK | | 4 GPa |
| PEKK | | 4 GPa |
| Aramid | | 80 GPa |

The core and the thread wrapped around it can have an adhesive coating. The wrapped core can have an optional adhesive overcoat to penetrate into the thread and create good adhesion between the wrapped core and thread (and the rubber of a rubber product the cord is subsequently placed in). Suitable overcoat adhesives include those suitable for bonding to the rubber compounds used for rubber belts mainly, but not exclusively HNBR, EP type (EPM, EPDM) or CR rubbers. EP=ethylene propylene based rubbers, EPM=ethylene propylene monomer based rubber and EPDM=ethylene propylene monomer based rubber with diene monomer.

The adhesive may be solvent based or water based. The adhesive overcoating process is well understood in the industry; one example is presented on the website www.ngf-glasscord.com. An example of impregnating strands with a rubber composition is discussed in U.S. Pat. No. 5,368,928A, Okamura et al.

Embodiments of cords of the invention include:

A cord as described above, wherein: the core comprises one strand of carbon filaments impregnated in a polymer; the linear density of the core is from 300 to 1000 g/km; the linear density of the thread is from 2 to 8 g/km; and the thread is wrapped around the core at a twist of 1000 to 5000 tpm.

A cord as described above, wherein: the core comprises one strand of 6000 carbon filaments; the core has a linear density of 400 g/km; and the core is wrapped with a thread of polyester or nylon having a linear density of from 4 to 6 g/km.

A cord as described above, wherein: the core comprises one strand comprising 6000 carbon filaments with a primary twist of 80 tpm; the core has a linear density of 400 g/km; and the core is wrapped with a thread of polyester or nylon having a linear density of from 4 to 6 g/km at 1000 tpm.

A cord as described above, wherein: the core is impregnated with a polymer and the core comprises a single strand of filaments impregnated and then twisted (primary twist) or the core comprises two or more strands that have each been impregnated and twisted (primary twist) and then twisted together (secondary twist); and optionally, the wrapped core has overcoat to penetrate into the thread and create good adhesion between the wrapped core and thread (and the rubber of a rubber product the cord is subsequently placed in).

A cord as described above, wherein: the core comprises a single strand of 6000 carbon filaments and is impregnated with HNBR latex rubber and a crosslinking agent which will react during rubber belt vuclanization; the core is wrapped with a thread of polyester or nylon having a linear density of 4 to 6 g/km; and optionally the wrapped core has an adhesive overcoat, wherein the adhesive is suitable for bonding to HNBR or EP type (EPM, EPDM) rubber compounds used for rubber belts.

A cord as described above, wherein: the core comprises one strand comprising a bundle of 12000 carbon filaments with a primary twist of 40 tpm; the core has a linear density of 800 g/km; and the core is wrapped with a thread of nylon having a linear density of from 4 to 6 g/km at from 1000 to 5000 tpm.

In another aspect, the invention provides a method of preparing the cord of the invention comprising obtaining a core which comprises at least one strand of filaments, and wrapping at least one thread around the core. That is, the invention provides a cord for reinforcing a rubber product comprising wrapping a thread around a core, wherein the core comprises at least one strand of filaments. The cord, i.e. the core and the thread, is/are as described above. Thus, the method can be used to prepare the reinforcing cords of the first aspect of the invention. By wrapping is meant that the thread sits on the exterior of the core and, for example, the thread and the core are not intertwined or twisted together.

The core can be obtained by means known in the art. First, a plurality of filaments are bundled together to form a bundle of filaments. This bundle of filaments forms a strand. The strand of filaments is optionally impregnated with an impregnating liquid as defined above. The strand (impregnated or not) can be twisted in the one direction to obtain a primary twist. The core can be formed of one such strand. Alternatively, two or more strands (impregnated or not) are twisted together, typically in the same direction, to form the core. Once the core is formed, the at least one thread is wrapped around the core to give the desired turns per metre. An optional adhesive coating can be applied to the wrapped core.

In another aspect, the invention provides a method of increasing the resilience of a core to bending, wherein said core comprises at least one strand of filaments, wherein said method comprises wrapping at least one thread around the core. The core is as described herein for the other aspects of the invention.

In another aspect, the invention provides a rubber product comprising a rubber composition and at least one reinforcing cord according to the first aspect of the invention embedded in the rubber composition. The rubber product is reinforced by the reinforcing cord of the present invention. The rubber product is not particularly limited. Examples of the rubber product of the present invention include tires for automobiles and bicycles, and transmission belts. Examples of the transmission belts include synchronous transmission belts and friction transmission belts. Examples of the synchronous transmission belts include toothed belts typified by a timing belt for an automobile. Examples of the friction transmission belts include flat belts, round belts, V belts, and V-ribbed belts. That is, the rubber product of the present invention may be a toothed belt, a flat belt, a round belt, a V belt, or a V-ribbed belt.

The rubber product of the present invention is formed by embedding the reinforcing cord of the present invention in a rubber composition (a matrix rubber). The method for embedding the reinforcing cord into the matrix rubber is not particularly limited, and any known method may be employed. The reinforcing cord of the present invention is embedded in the rubber product of the present invention (for example, a rubber belt). Therefore, the rubber product of the present invention has high bending fatigue resistance. Accordingly, the rubber product of the present invention is particularly suitable for use as a timing belt for a vehicle engine. Such belts may include other components such as one or more fabric layers, low friction coatings, adhesive treatments and internal fillers in the rubber compound.

The rubber of the rubber composition in which the reinforcing cord of the present invention is to be embedded is not particularly limited. The rubber may be chloroprene rubber, chlorosulfonated polyethylene rubber, ethylene propylene rubber, hydrogenated nitrile rubber, or the like. The hydrogenated nitrile rubber may be a hydrogenated nitrile rubber containing a zinc acrylate derivative (for example, zinc methacrylate) dispersed therein. At least one rubber selected from the hydrogenated nitrile rubber and the hydrogenated nitrile rubber containing a zinc acrylate derivative dispersed therein is preferred from the viewpoints of water resistance and oil resistance. The matrix rubber may further contain carboxyl-modified hydrogenated nitrile rubber. From the viewpoint of adhesion, it is preferable that any adhesive coating layer on the reinforcing cord and the rubber composition of the rubber product be matched for good bonding, and may contain the same type of rubber or consist of the same type of rubber.

As used herein, the term "comprising", which is inclusive or open-ended and does not exclude additional unrecited elements or method steps, is intended to encompass as alternative embodiments, the phrases "consisting essentially of" and "consisting of", where "consisting of" excludes any element or step not specified and "consisting essentially of" permits the inclusion of additional unrecited elements or steps that do not materially affect the essential or basic and novel characteristics of the composition or method under consideration.

Embodiments of the invention are described in the following numbered clauses:

1. A cord for reinforcing a rubber product, comprising a core and at least one thread wrapped around the core, wherein the core comprises at least one strand of filaments, and wherein the linear density of the core is greater than the linear density of the thread.
2. A cord according to clause 1, wherein the core has a linear density of at least 200 g/km and the thread has a linear density of not more than 50 g/km.
3. A cord according to clause 2, wherein the core has a linear density of from 200 to 8000 g/km and the thread has a linear density of not more than 10 g/km.
4. A cord according to any one of the preceding clauses, wherein the core has a twist of greater than zero and the thread is wrapped around the core at a number of turns per metre that is from 1.5 to 150 times the twist of the core, and wherein (i) the core comprises a single strand which has a primary twist of greater than zero and the primary twist is the twist of the core, or (ii) the core comprises two or more strands which are twisted together to give a secondary twist of greater than zero and the secondary twist is the twist of the core.
5. A cord according to clause 4 wherein the twist of the core is greater than zero and up to 240 tpm and the thread is wrapped around the core at from 500 to 8000 tpm.
6. A cord according to any one of the preceding clauses, wherein the or each strand of filaments is impregnated with a polymer (or aqueous polymer dispersion).
7. A cord according to any one of the preceding clauses, wherein the core comprises a single strand.
8. A cord according to any one of the preceding clauses, wherein said core comprises two or more strands.
9. A cord according to any one of the preceding clauses, wherein the core and the thread wrapped around the core is covered with an adhesive layer.
10. A cord according to any one of the preceding clauses, wherein the core is wrapped with one thread.
11. A cord according to any one of the preceding clauses, wherein the core is wrapped with two or more threads.
12. A cord according to any one of the preceding clauses, wherein the cross-sectional area of the core is at least 40% of the cross-sectional area of the cord.
13. A cord according clause 12, wherein the cross-sectional area of the core is at least 80% of the cross-sectional area of the cord
14. A cord according to any one of the preceding clauses, wherein said core has a diameter ranging from 0.5 to 2.5 mm, preferably 0.5 to 1.2 mm.
15. A cord according to any one of the preceding clauses, wherein diameter of the core is from 0.5 to 2.5 mm or from 0.5 to 1.2 mm and the diameter of the thread is from 0.005 to 0.5 mm.
16. A cord according to any one of the preceding clauses, wherein the diameter of core plus the diameter of the thread (or the diameter of two threads) does not exceed 3.0 mm.
17. A cord according to any one of the preceding clauses, wherein the filaments are carbon, glass, basalt and/or aramid filaments either as a single material or as a combination of materials
18. A cord according to any one of the preceding clauses, wherein the thread is any of: nylon, polyester, acrylic, elastic polyurethane, PPS, PEEK, PEKK or aramid.
19. A method of preparing a cord according to any one of the preceding clauses, comprising obtaining a core which comprises at least one strand of filaments, and wrapping at least one thread around the core.
20. A method of increasing the resilience of a core to bending, wherein said core comprises at least one strand of filaments and wherein said method comprises wrapping at least one thread around the core.
21. A rubber product comprising a rubber composition; and at least one cord according to any one of clauses 1 to 18 embedded in the rubber composition.
22. A rubber product according to clause 21, wherein the rubber product is a tyre, a timing belt or other power transmission belt.

The invention is illustrated by the following non-limiting examples.

EXAMPLES

Cords listed in the table below were prepared. The cord of Comparative Example 1 was used as the central core for the wrapping samples. The cord of Comparative Example 1 comprises one strand and the strand is a bundle of 12000 carbon fibres impregnated by a polyurethane latex. The strand has linear density of 800 g/km and the bundle of carbon fibres has a twist of 40 turns per metre (tpm).

| Cord | Core | Impregnation details | Core Twist (tpm) | Wrapping thread | Wrapping twist (tpm) |
|---|---|---|---|---|---|
| Comparative Example 1 | One strand of 12K carbon fibre, with a linear density of 800 g/km. | Polyurethane latex, as 18% by weight of the dried core. Core 976 g/km | 40 | none | — |
| Example 1 | One strand of 12K carbon fibre, with a linear density of 800 g/km. | Polyurethane latex, as 18% by weight of the dried core. Core 976 g/km | 40 | 4.4 g/km nylon 6 | 1000 |
| Example 2 | One strand of 12K carbon fibre, with a linear density of 800 g/km. | Polyurethane latex, as 18% by weight of the dried core. Core 976 g/km | 40 | 4.4 g/km nylon 6 | 1670 |
| Example 3 | One strand of 12K carbon fibre, with a linear density of 800 g/km. | Polyurethane latex, as 18% by weight of the dried core. Core 976 g/km | 40 | 4.4 g/km nylon 6 | 5000 (two thicknesses of wrap) |

Figure 2:
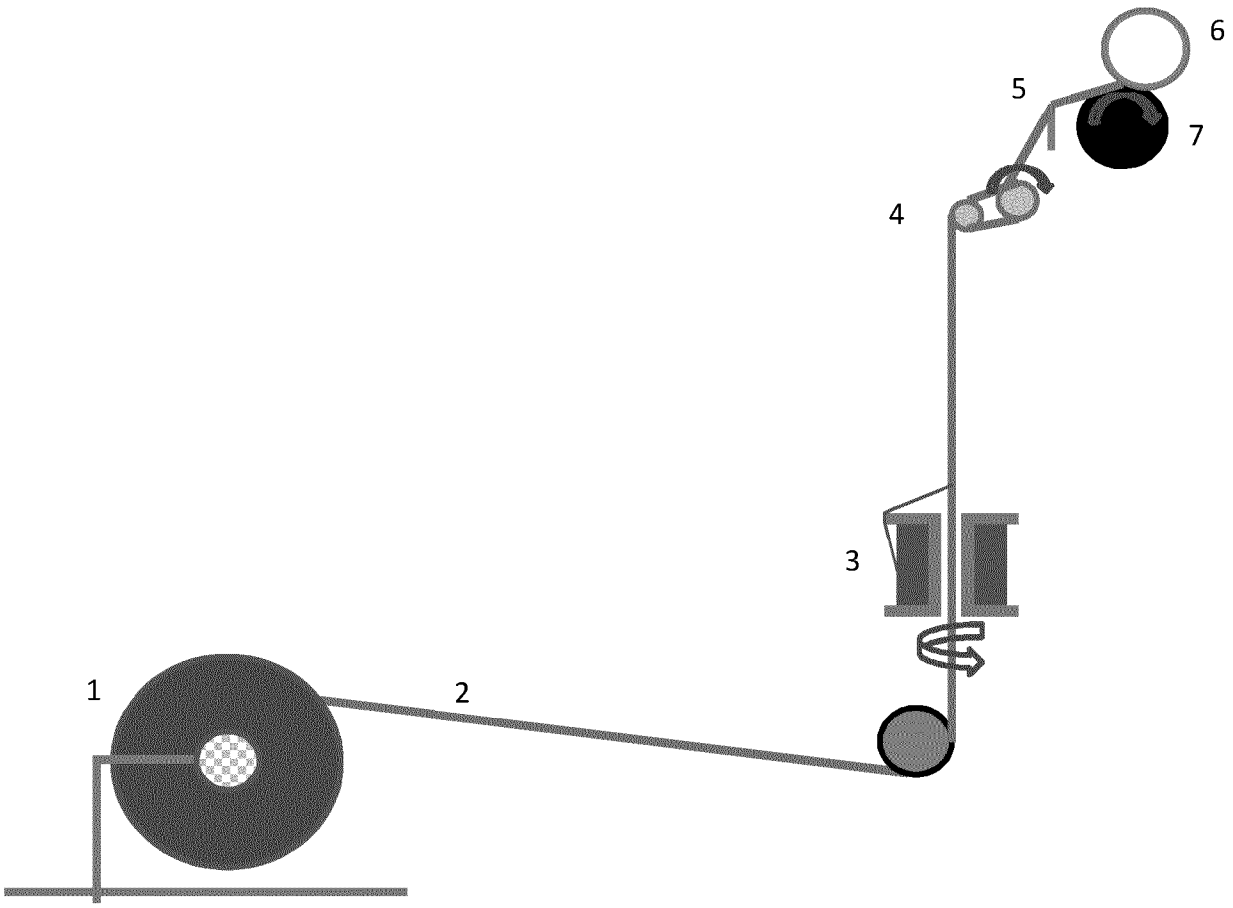
FIG. 2 is a schematic of the machine used to prepare the cords of the invention in the examples section, in which 1 is the bobbin holder, 2 is the feed of core strand, 3 is the wrapping thread, 4 is the capstan, 5 is the traversing needle, 6 is the take up tube and 7 is the take up drive.

The wrapped cords of Examples 1 to 3 were produced using a covering machine manufactured by Ratti Luino, similar to the OMM SP-R (http://www.rattiluino.com/en/prodotto/sp-r/). The layout of this machine is shown schematically in FIG. 2. The core was pulled through the machine at a rate varied between 1 and 10 m/min. A single wrapping thread was used, rotating around the core at a speed of between 3000 and 15000 rpm. The thread was not pre-twisted around itself, i.e. the thread itself did not have a primary twist. The throughput and rotation speeds were varied in order to change the turns per metre of thread wrapped around the core (turns per metre=the rotation speed divided by the throughput speed of the core).

The equipment used was designed for covering a low Tex thread with one or two low Tex threads (the unit of Tex=weight 1000 m of thread per gram). The equipment was not designed with the heavier materials of this invention in mind and to avoid slippages during sample manufacture, parts had to be turned by hand, or kept under tension by hand.

The wrapped cord samples were measured on a tensile test machine using 3-point bending in compression. The layout is as shown in FIG. 1, and is described in ISO 178 (Plastics—Determination of flexural properties). The contact points were 10 mm diameter rods. The span of the two supporting rods was 30 mm. A speed of 5 mm/min was used for the bending test. The test output was the bending stress as a function of the maximum bending strain due to the displacement. The bending modulus (ratio of stress to strain) was reported as the stress measured when 1% maximum bending strain was reached.

The bending modulus reflects the tendency of the material to resist bending; the higher the bending modulus, the more resistant it is to bending under a bending stress.

Each cord sample was tested five times and the average result of these five tests for each cord sample is shown in the table below:

| | Thread twist around core, Turns per metre | Stress at 1% max strain, MPa | Did the cord crimp? |
|---|---|---|---|
| Comparative Example 1 | — | 15.9 | Yes |
| Example 1 | 1000 | 18.2 | Yes |
| Example 2 | 1670 | 20.3 | No |
| Example 3 | 5000 (double) | 23.9 | No |

Figure 3:
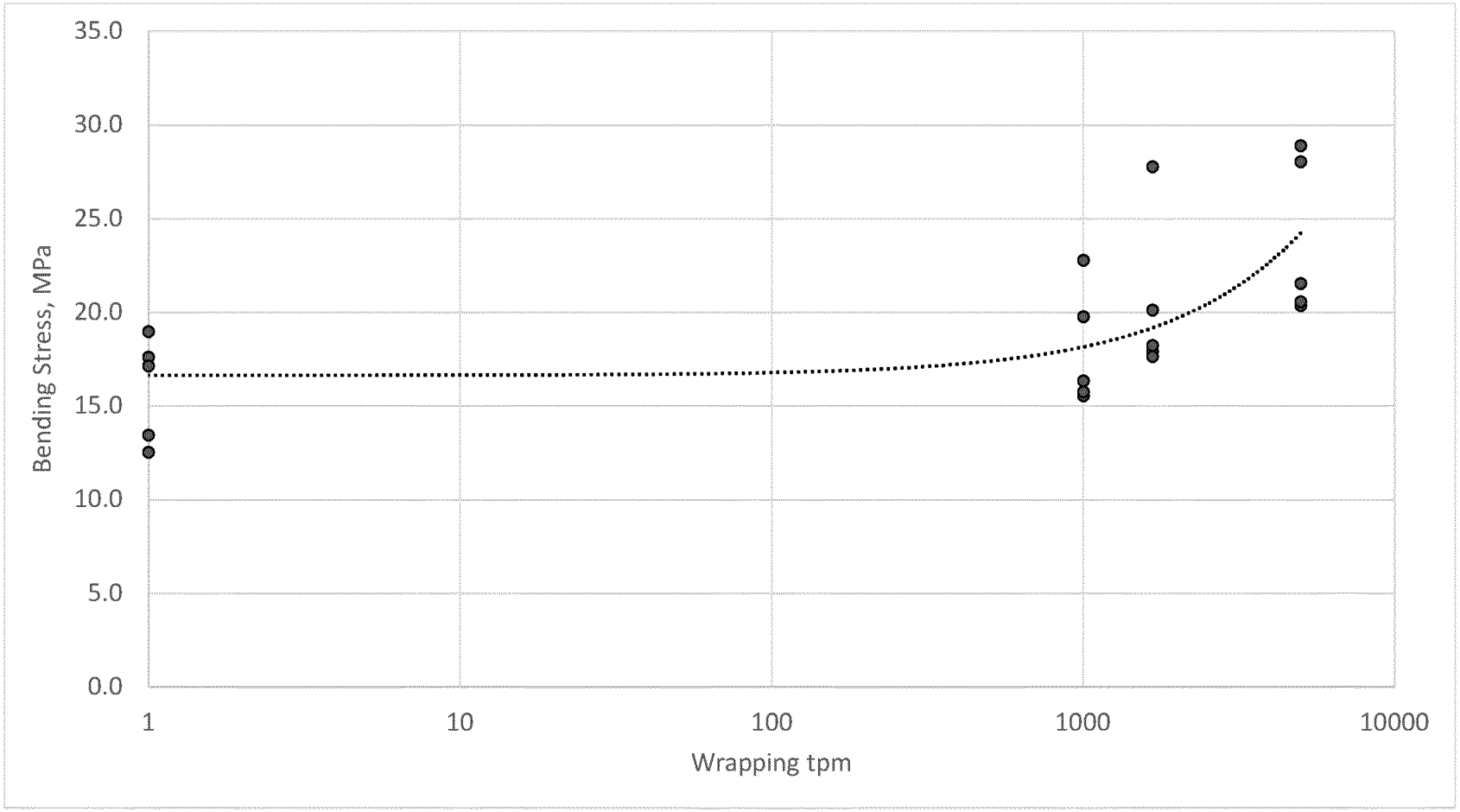
FIG. 3 is a graph showing the increase in cord stiffness with thread wrapping turns per metre, i.e. a graph of the bending of wrapped carbon fibre cord samples with bending represented by bending stress at 1% maximum bending strain.

The results show that example cords with a thread wrap above 1000 tpm showed significantly higher stress at 1% strain, i.e. a significantly higher bending modulus, than the unwrapped current cord. Thus, the wrapped cords of the invention have an increased stiffness over the unwrapped cord of the comparative example. This increase in stiffness prevents crimping of the cord in the high twist cases. A logarithmic dependence in stiffness (represented by bending stress at 1% maximum bending strain) was observed versus wrapping turns per metre and this is shown in FIG. 3. The results show that the presence of the wrapping thread stiffens the carbon central core, and can prevent it from crimping.

The invention claimed is:

1. A cord for reinforcing a rubber product, comprising a core and at least one thread wrapped around the core, wherein the core comprises at least one strand of filaments, wherein the core has a linear density of 400 to 8000 g/km and each of the at least one thread has a linear density of not more than 20 g/km, wherein each of the at least one strand of filaments is impregnated with a polymer or an aqueous polymer dispersion, wherein each of the at least one thread is a bundle of filaments, and wherein the filaments of the core do not contain aramid.

2. A cord according to claim 1, wherein the core has a twist of greater than zero and each of the at least one thread is wrapped around the core at a number of turns per metre that is from 1.5 to 150 times the twist of the core, and wherein (i) the core comprises a single strand which has a primary twist of greater than zero and the primary twist is the twist of the core, or (ii) the core comprises two or more strands which are twisted together to give a secondary twist of greater than zero and the secondary twist is the twist of the core.

3. A cord according to claim 2 wherein the twist of the core is greater than zero and up to 240 tpm and each of the at least one thread is wrapped around the core at from 500 to 8000 tpm.

4. A cord according to claim 1, wherein the core comprises two or more strands.

5. A cord according to claim 1, wherein the core and each of the at least one thread wrapped around the core are covered with an adhesive layer.

6. A cord according to claim 1, wherein the core is wrapped with two or more threads.

7. A cord according to claim 1, wherein the cross-sectional area of the core is at least 40% of the cross-sectional area of the cord.

8. A cord according to claim 1, wherein said core has a diameter ranging from 0.5 to 2.5 mm.

9. A cord according to claim 1, wherein diameter of the core is from 0.5 to 2.5 mm and the diameter of each of the at least one thread is from 0.005 to 0.5 mm.

10. A cord according to claim 1, wherein the diameter of core wrapped with a single layer of each of the at least one thread does not exceed 3.0 mm.

11. A cord according to claim 1, wherein the filaments of the core are carbon, glass, and/or basalt filaments either as a single material or as a combination of materials, or wherein the filaments of the core are carbon, glass and/or basalt filaments either as a single material or as a combination of materials.

12. A cord according to claim 1, wherein each of the at least one thread is any of: nylon, polyester, acrylic, elastic polyurethane, polyphenylene sulphide (PPS), polyetheretherketone (PEEK), polyetherketoneketone (PEKK), or aramid.

13. A cord according to claim 1, wherein the modulus of the core is greater than the modulus of each of the at least one thread.

14. A cord according to claim 13, wherein the modulus of the core is at least five times greater than the modulus of each of the at least one thread.

15. A cord according to claim 1, wherein the cord is metal-free.

16. A method of preparing a cord according to claim 1, comprising obtaining a core which comprises at least one strand of filaments, and wrapping at least one thread around the core.

17. A rubber product comprising a rubber composition; and at least one cord according to claim 1 embedded in the rubber composition.

18. A rubber product according to claim 17, wherein the rubber product is a tire, a timing belt or other power transmission belt.

* * * * *